US005189957A

United States Patent [19]

Kobler et al.

[11] Patent Number: 5,189,957

[45] Date of Patent: Mar. 2, 1993

[54] SHEET-CONVEYING DRUM FOR SKEW REGISTER CORRECTION

[75] Inventors: Ingo Kobler, Anhausen; Roland Holl, Weiterstadt; Dietrich Dettinger, Heusenstamm, all of Fed. Rep. of Germany

[73] Assignee: MAN Roland Druckmaschinen AG, Fed. Rep. of Germany

[21] Appl. No.: 690,855

[22] Filed: Apr. 24, 1991

[30] Foreign Application Priority Data

Apr. 24, 1990 [DE] Fed. Rep. of Germany ..... 4012928

[51] Int. Cl.[5] ..... B41F 21/10

[52] U.S. Cl. ..... 101/409

[58] Field of Search ..... 101/232, 409, 410, 411, 101/412, 246, 183, 246, 475; 271/184, 314, 82

[56] References Cited

U.S. PATENT DOCUMENTS 4,922,819 5/1990 Ishii ..... 101/232

*Primary Examiner*—J. Reed Fisher

*Attorney, Agent, or Firm*—Leydig, Voit & Mayer

[57] ABSTRACT

A sheet-conveying drum for skew register correction in multicolor printing that does not affect the drive in sheet-fed rotary presses. The sheet-conveying drum comprises gripper bars and support or carrying webs that are disposed on a drum shaft. The web disposed nearest the drive input has on its flange an arcuate bearing surface around which the drum body can be skewed relatively to the drum shaft. The web disposed opposite the drive input is coupled to an adjusting eccentric bushing by way of a flange to cause the drum to skew. The movements of drum skewing do not adversely affect the drive and, therefore, the transmission ratios of the sheet-guiding cylinders relative to one another.

14 Claims, 4 Drawing Sheets

SHEET-CONVEYING DRUM FOR SKEW REGISTER CORRECTION

FIELD OF INVENTION

The invention relates generally to printing presses, and more specifically to drums for conveying sheets through such presses.

BACKGROUND OF THE INVENTION

In the printing of multicolor images on printed sheets, care must be taken to ensure that the subimages register accurately with one another. Orientation lengthwise and laterally of the image can be provided by means of conventional peripheral and lateral register devices on sheet-fed presses. However, the skew of the image cannot readily be corrected by these means. Consequently, transfer devices have been developed that permit skewing of the printed sheets as they are conveyed through the press so that the sheets are properly oriented for accurate subimage registration.

A device of this kind is disclosed in DE-OS 3 400 652. The aim of the sheet-fed press disclosed therein is to enable a correcting cylinder to be adjusted at its control side or end relative to its set-value or reference position. Therefore, the axis of the correcting cylinder is skewed as a whole relative to the adjacent cylinders. Placement of the skew adjuster on the control side permits better control and reduces assembly costs.

The disadvantage of the device disclosed in DE-0S 3 400 652 is that the skewing affects the transmission of drive mechanisms. Displacing the cylinder always causes a skewing, and, in the worst case, even a displacement of a gear in the drive train relative to the adjacent gears. This is true whether the cylinder is displaced directly on the transmission side or on the opposite side, although the position in this connection is not known. Thus, although the device improves sheet transfer, it likewise increases problems in the drive train.

DE-C1 37 04 314 discloses an arrangement for adjusting tooth backlash between the drive gears of sheet-conveying rollers and drums of sheet-fed rotary presses wherein eccentric bushings are provided at both ends for the mounting of each drum. The bushings provide parallel displacement of the drums to adjust the backlash during operation. The arrangement does not provide for skewing the drums and skewing cannot be effected without upsetting drive ratios.

OBJECTS AND SUMMARY OF THE INVENTION

It is an object of the invention to provide a skewable sheet-conveying drum for conveying sheets through a press which does not affect drive gear engagement by the additional skewing action on sheet register adjustment.

It is a more specific object of the invention to provide, a device for conveying sheets through a press which obviates any change in drive ratios as a result of skewing of a sheet-conveying drum.

In accordance with the invention, the drive shaft of a sheet-conveying drum is non-displaceably mounted at one end within a bearing on the input side of the drum. The drum is mounted for translational movement such that the drum body is pivotable about the axis of the input bearing. This isolation of the pivoted parts of the drum from the input gear permits skew correction by drum or cylinder skewing in a broad range of applications. More particularly, the invention simplifies the procedure for correction of skew. Moreover, the invention has a significant effect on bearing loading and drive ratio accuracy. The invention permits the input gear and the bearing of the input journal to remain in their respective positions during skewing. Indeed, in one embodiment of the invention, the entire drum mounting can remain in its original position. Therefore, the drum does not require expensive bearings and means for guiding the same during displacements.

Various embodiments of the invention which isolate the skewing movement in a sheet-conveying drum from the drum input bearing or drum input gear are discussed below, however, the invention is not intended to be limited to those embodiments. In one embodiment, the drum shaft has elements that move one end radially in relation to the axis of the input bearing, which is radially and peripherally immobile. In another embodiment, a skewable, but generally rigid drum body is disposed on a rigid drum shaft.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

BRIEF DESCRIPTION OF THE PREFERRED EMBODIMENTS

The invention will be described by way of example hereinafter with reference to illustrations. The alteration in the position of the drum body and the axis thereof is shown in dotted lines in the respective FIGURES.

Figure 1:
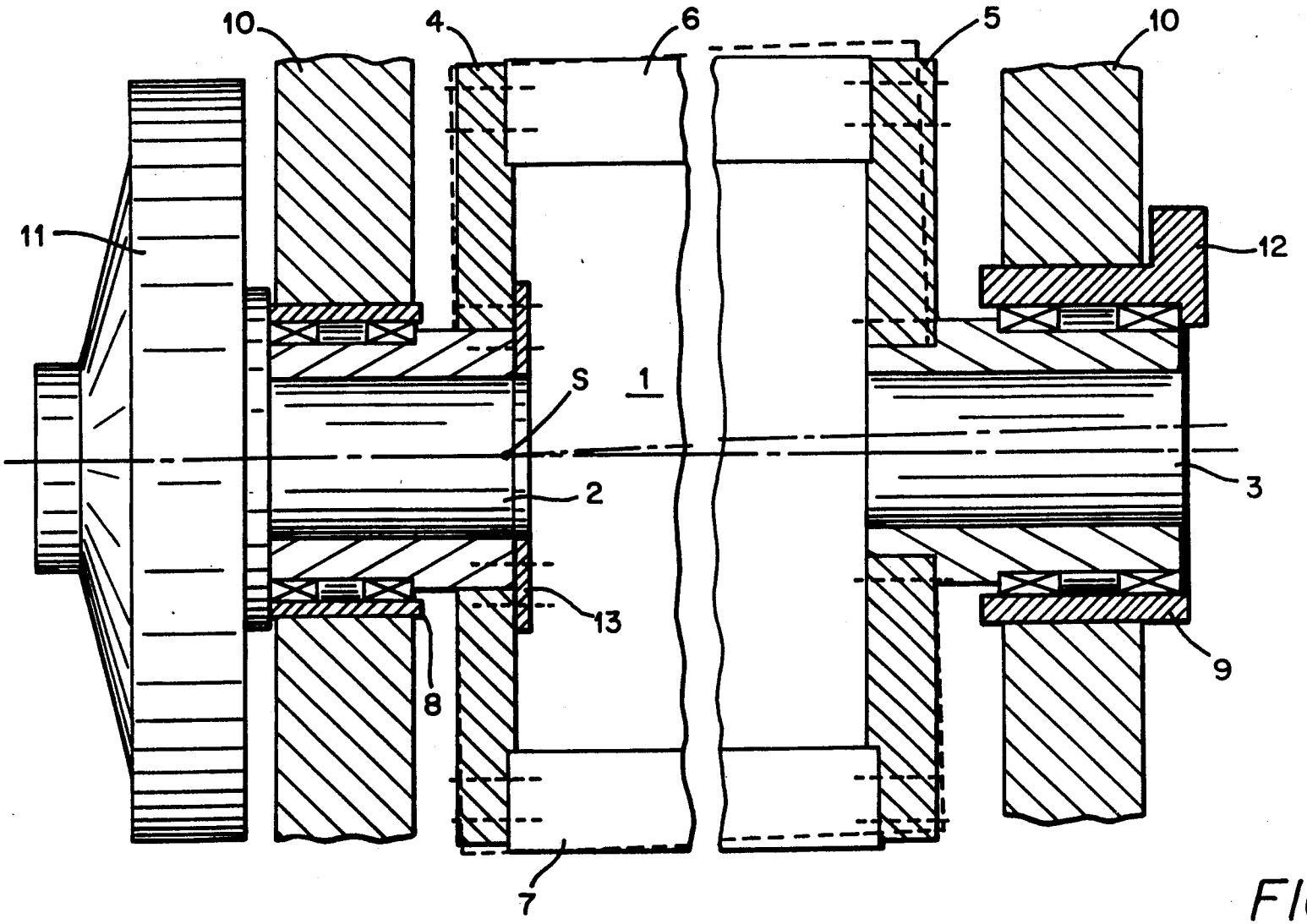
FIG. 1 shows a sheet-conveying drum of the present invention with the skewing feature.

FIG. 1 shows a sheet-conveying drum 1 according to the invention. The drum 1 comprises an input journal 2 and an output journal 3, and support webs 4, 5, which are flanged on to the journals 2, 3, respectively. Gripper bars 6, 7, which convey the sheets, are provided between the webs 4 and 5. The journals 2, 3 are mounted in bearings 8, 9, respectively, in frame elements, or the press wall 10. An input or drive gear 11 is secured to input journal 2. At the opposite end an adjusting eccentric bushing 12 is also provided on the bearing 9 to enable the drum shaft to be pivoted. Rotation of the eccentric bushing 12 by means of a drive (not shown) skews the position of the drum shaft through a pivoting angle at point S from its normal position, as indicated by a dotted line in FIG. 1. The point S is disposed on the drum shaft at the inner edge of the input journal 2. In order to prevent the input gear 11 from tilting as the drum shaft tilts, a coupler having a lower resistance to radial movement than the input journal 2 is provided at the junction between the input-end web 4 and the journal 2. The coupler permits the web 4 to tilt relative to the journal 2, however, the coupler does not permit relative rotary and radial movement of the web 4 and the journal 2.

Figure 2:
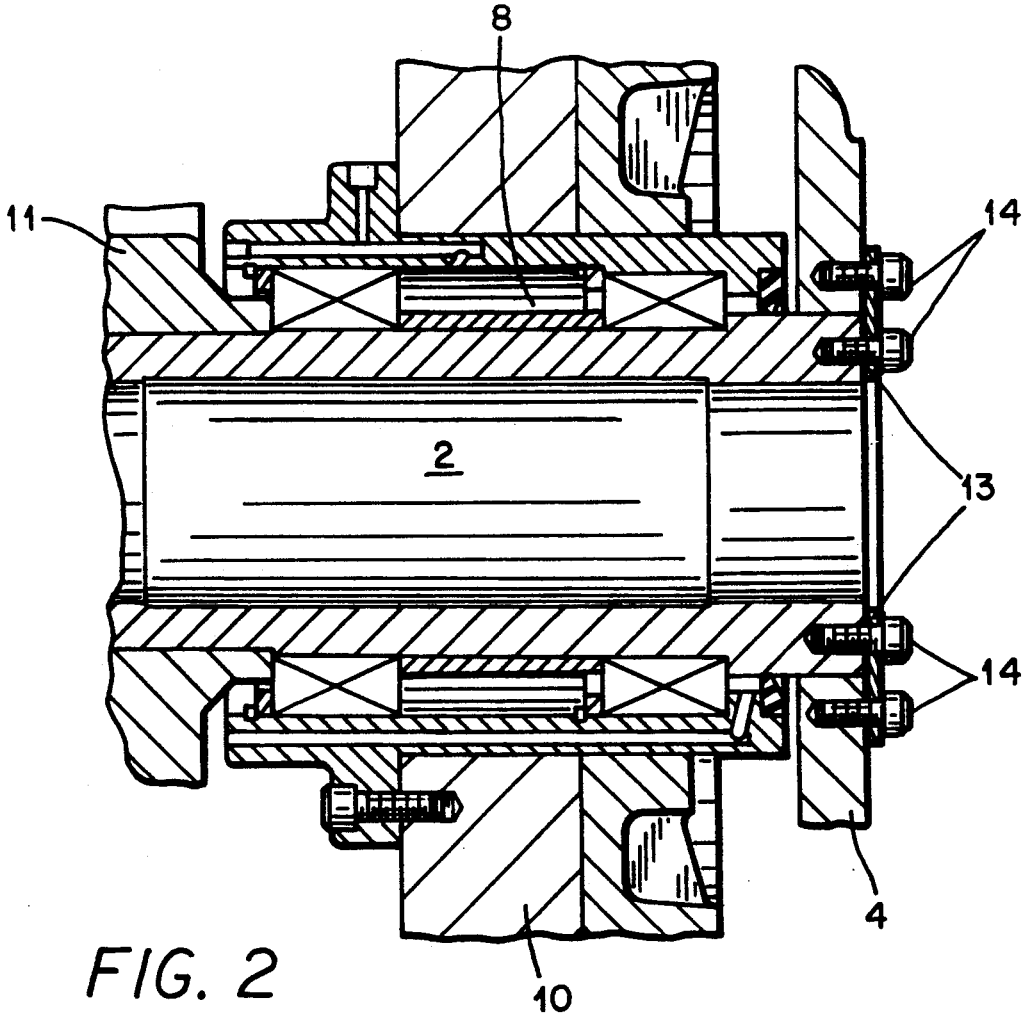
FIG. 2 is a partial view showing the junction of the drum body web and the input journal.

FIG. 2 shows the construction of the junction in the connection between the web 4 and the input journal 2. It will be appreciated that the input journal 2 carries the input gear 11 and is guided in the bearing 8. The web 4 is disposed at the inner end of the journal 2 and is connected thereto by way of an annular coupling diaphragm 13. The diaphragm is connected to the inner end face of the input journal 2 and to the inner periphery of the web 4 by means of uniformly distributed sets of connecting screws 14. The web 4 and the input journal 2, therefore, remain flush with one another, axial movements being substantially obviated. However, the diaphragm 13 permits bending around the connection.

Figure 3:
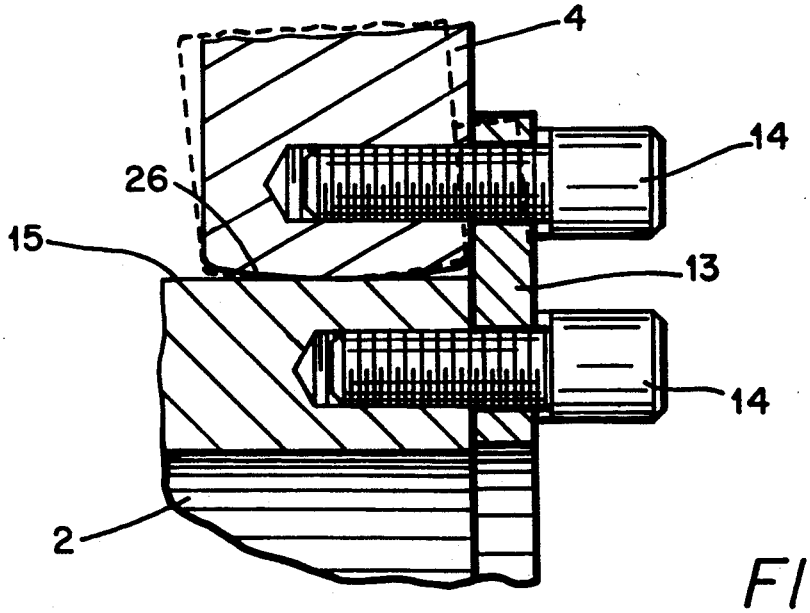
FIG. 3 shows an enlarged, fragmentary view junction between the input journal and the drum body shown in FIG. 2, and FIGS. 4 and 5 show alternate embodiment of the invention as shown in FIG. 1.

Referring to FIG. 3, there is shown an enlarged, fragmentary view of the diaphragm 13 and the junction between the web 4 and the input journal 2. The inner peripheral surface 26 of the web 4, which is disposed opposite the outer peripheral surface 15 of the input journal 2, is arcuate in cross-section—i.e., axially of the drum 1. In this way, the web 4 contacts the input journal 2 in a substantially linear manner along its peripheral surface 15. When the eccentric bushing 12 is adjusted, the drum body and, therefore, the web 4 are skewed relatively to the input journal 2. The skewing occurs in a fixed plane determined by the eccentric bushing 12 and lies substantially perpendicularly to the plane connecting the axes of sheet-guiding cylinders, such as impression cylinders of a sheet-fed offset press, cooperating with the drum As seen radially, therefore, the diaphragm 13 experiences axial resilient deformation in its central zone, the web 4 rocking or "rolling" by way of its arcuate inner peripheral surface 26 on the outer peripheral surface 15 of the input journal 2. Since the pivoting plane is static, the deflection at the junction between the input journal 2 and the web 4 rotates relatively to the drum 1 in accordance with the rotational movement. However, the total movement is minimal. For an eccentricity of, for example, 5 mm at the eccentric bushing 12, a pivoting distance of approximately 5/100 mm is likely at the interface of the diaphragm 13 and the web 4 and can readily be taken up by the diaphragm 13. The actual pivoting distances are much smaller since the adjustments are in the region of 1/10 mm. The pivoting of the web 4 and the flexing of the diaphragm 13 are shown in dotted lines in the enlarged fragmentary view shown in FIG. 3.

Figure 4:
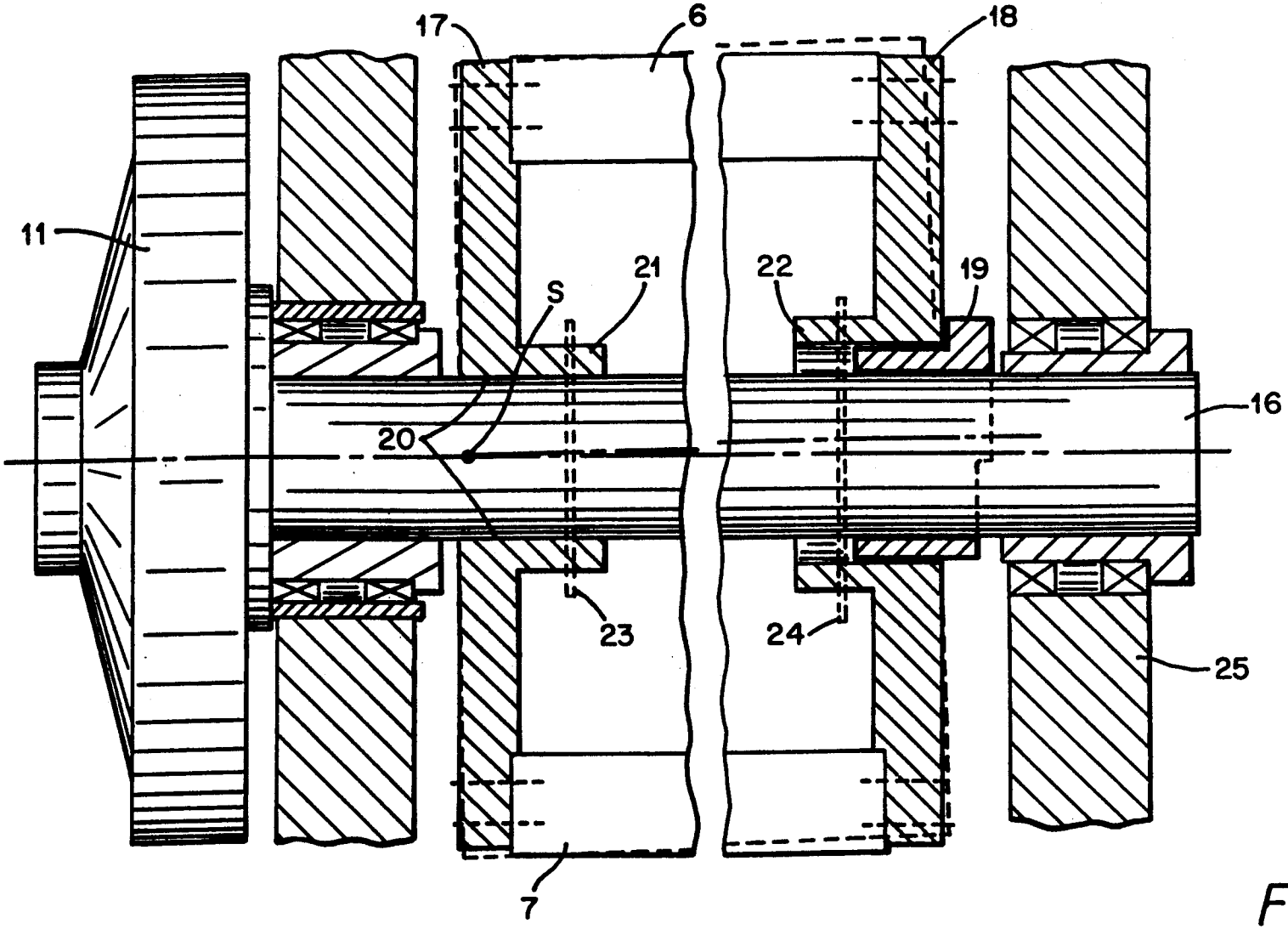

FIG. 4 shows an alternate embodiment of the invention in which the drum body is skewed on a continuous drum shaft 16. To this end the drum body is mounted by way of webs 17, 18 at two places on the drum shaft 16, the webs 17, 18 being connected to the drum shaft 16 in peripherally rigid manner. At the end remote from the input gear 11, adjusting eccentric bushing 19 is provided between the web 18 and the shaft 16. The adjusting eccentric bushing 19 enables the drum member to be skewed relatively to the drum shaft 16. To obviate bending of the shaft 16 due to the skewing of the web 17, the web 17 has an arcuate bearing surface 20 associated with the shaft 16. By displacing the web 18 and shifting its center, the web 17 rolls at the input end on its arcuate bearing surface 20. Thus, the drum skews sheet transfer without bending of the drum shaft 16. The webs 17, 18 are secured by way of flange 21, 22 to the shaft 16 and rigidly connected peripherally thereto by pins 23, 24. An appropriate adjusting drive can be disposed either to rotate on the web 18 or to be stationary on press frame 25 with a coupling transmission extending through the shaft 16.

Figure 5:
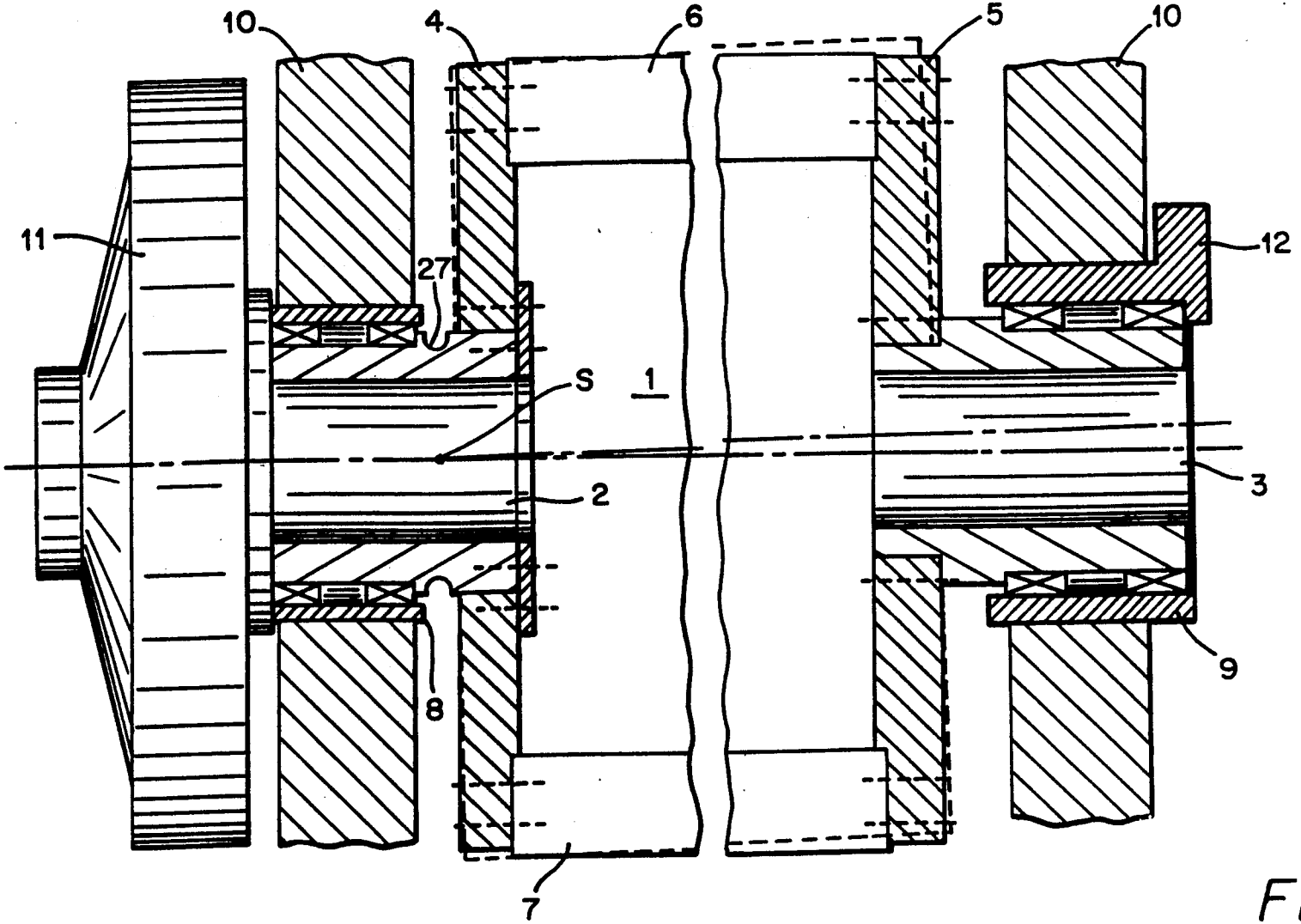

In yet another embodiment of the invention, a groove 27 is provided in the shaft in the transition between the journal and the drum body, as indicated by dotted lines in FIG. 5. The groove 27 permits flexing of the shaft at this place to skew the drum body without flexing the bearing and the input gear.

We claim as our invention:

1. A skewable sheet-conveying drum mounted for rotation in bearings supported by frame elements, one of said bearings being a drive-side bearing defining a primary axis, comprising, in combination, a drum body including first and second end webs, shaft means including first and second shaft ends for journalling said drum body in said bearings, said first shaft end having a shaft axis and being non-displaceably mounted in the drive-side bearing such that the first shaft end axis and the primary axis are coaxial, means for coupling said first and second drum end webs to the first and second shaft ends such that rotational input applied to the first shaft end imparts rotational movement through the first end web to the drum body, and means for causing translational movement of the second drum end web radially with respect to the primary axis to pivot the drum body relative to the first shaft end and skew the drum body relative to the first shaft end axis and the primary axis.

2. A skewable sheet-conveying drum according to claim 1 wherein said means for causing translational movement of the second drum end web includes an eccentric bushing mounted for rotation around the second shaft end.

3. A skewable sheet-conveying drum according to claim 2 wherein said eccentric bushing is disposed between the second shaft end and one of the supporting frame elements.

4. A skewable sheet-conveying drum according to claim 3 wherein said eccentric bushing is mounted for rotation in the one frame element and supports the bearing journalling the second shaft end.

5. A skewable sheet-conveying drum according to claim 2 wherein said eccentric bushing is disposed between the second shaft end and the second drum end web.

6. A skewable sheet-conveying drum according to claim 5 wherein the first end web includes an inner opening having an arcuate surface, the first shaft end being disposed within the opening such that the first end web rocks on the shaft when the drum body pivots with respect to the primary axis.

7. A skewable sheet-conveying drum according to claim 6 wherein the shaft first and second ends are connected as a single element.

8. A skewable sheet-conveying drum according to claim 1 wherein the first and second ends of the shaft are connected as a single unit and the shaft further includes means for permitting bending the shaft, said bending permitting means being disposed along a section of the shaft between the drive-side bearing, and the drum body.

9. A skewable sheet-conveying drum according to claim 8 wherein the bending permitting means comprises a circumferential groove on the shaft.

10. A skewable sheet-conveying drum mounted for rotation in bearings supported by frame elements, one of said bearings being a drive-side bearing defining a primary axis, comprising, in combination, a drum body including first and second end webs, the first end web including an inner opening having an arcuate surface, shaft means including first and second shaft ends for journalling said drum body in said bearings, said first shaft end being non-displaceably mounted in the drive-side bearing, the first shaft end being disposed within the inner opening of the first web, means for coupling said first and second drum end webs to the first and second shaft ends such that rotational input applied to the first shaft end imparts rotational movement through the first end web to the drum body, and means for causing translational movement of the second drum end web radially with respect to the primary axis to pivot the drum body relative to the first shaft end and skew the drum body relative to the primary axis, the first end web rocking on the shaft when the drum body pivots with respect to the primary axis.

11. A skewable sheet-conveying drum according to claim 10 wherein said means for coupling the first drum end web to the first shaft end includes an annularly formed diaphragm and means for coupling the diaphragm to the first end web and the first shaft end, said diaphragm having a lower bending resistance than the first shaft end.

12. A skewable sheet-conveying drum according to claim 11 wherein said means for coupling the diaphragm comprises screws.

13. A skewable sheet-conveying drum mounted for rotation in bearings supported by frame elements, one of said bearings being a drive-side bearing defining a primary axis, comprising, in combination, a drum body including first and second end webs, the first end web including an inner opening having an arcuate surface, shaft means including first and second shaft ends for journalling said drum body in said bearings, said first shaft end being non-displaceably mounted in the drive-side bearing, said first shaft end being disposed within the inner opening of the first end web, means for coupling said first and second drum end webs to the first and second shaft ends such that rotational input applied to the first shaft end imparts rotational movement through the first end web to the drum body, and means for causing translational movement of the second drum end web radially with respect to the primary axis to pivot the drum body relative to the first shaft end and skew the drum body relative to the primary axis, the first end web rocking on the shaft when the drum body pivots with respect to the primary axis, said means for causing translational movement including an eccentric bushing mounted for rotation around the second shaft end between the second shaft end and one of the supporting frame elements.

14. A skewable sheet-conveying drum according to claim 13 wherein said means for coupling the first drum end web to the first shaft end includes an annularly formed diaphragm and means for coupling the diaphragm to the first end web and the first shaft end, said diaphragm having a lower bending resistance than the first shaft end.

* * * * *